United States Patent [19]

Belotta

[11] 4,267,931

[45] May 19, 1981

[54] ADJUSTABLE SHELVING RACK

[75] Inventor: Anthony S. Belotta, Bloomfield, N.J.

[73] Assignee: Warner-Lambert Co., Morris Plains, N.J.

[21] Appl. No.: 54,736

[22] Filed: Jul. 5, 1979

[51] Int. Cl.[3] ..... A47F 5/00; A47F 5/14

[52] U.S. Cl. ..... 211/153; 108/102; 211/181; 211/182

[58] Field of Search ..... 211/153, 181, 182; 108/102, 54.1; 312/214; 297/251; 52/712

[56] References Cited

U.S. PATENT DOCUMENTS

| | | | |
|---|---|---|---|
| 905,737 | 12/1908 | McCombe | 108/102 X |
| 2,266,274 | 12/1941 | Schroeder | 211/153 X |
| 2,948,405 | 8/1960 | Smith | 108/102 X |
| 3,221,677 | 12/1965 | Kerr | 108/102 |
| 3,998,170 | 12/1976 | Gordon | 211/153 X |
| 4,121,690 | 10/1978 | Rawlings | 182/223 X |

*Primary Examiner*—James T. McCall

*Attorney, Agent, or Firm*—Stephen I. Miller

[57] ABSTRACT

An adjustable shelving rack is disclosed having two elements. The first element includes two sections interconnected by a series of planar rungs, one of the sections being disposed above the plane formed by said rungs and the other section being disposed below the plane formed by said rungs. The second element includes two sections supporting a series of planar rungs having both of its sections disposed on the same side of the plane formed by said rungs. The rungs of both elements lie in the same plane when the two elements are coupled together.

8 Claims, 8 Drawing Figures

50
60
72
61
52
51
63
20
6
6
10
60
60
60
31
30
30
50
7
30'
7
70
10
30
20
32

61
72
31'
63
20
52
63
60
30
31
63
60
33
30'
70
20
30
33
32
10
20

52
50
60
51
10
63
60
30
33
30
31
70
33
70
30'
33
30
32
20

ADJUSTABLE SHELVING RACK

INTRODUCTION

The following invention relates to an expandable shelving rack, which expands incrementally in finite segments, with all horizontal surfaces on this adjustable shelving rack remaining in the same level plane.

Adjustable shelving rack has been known in the art before. U.S. Pat. No. 1,257,843 to Lewis J. Gonyea, issued Feb. 16, 1918, discloses an expandable kitchen tray, which expands by pulling out two adjustable sidings on either side of the tray. U.S. Pat. No. 2,299,885 to Ellsworth and Mills, issued Oct. 27, 1942, discloses adjustable shelving for a refrigerator compartment which expands incrementally, and sideways in the refrigerator compartment as opposed to an outward type of expansion. None of the prior art discloses an adjustable expansion of shelving, which expands not only incrementally, but levelly, with all horizontally expandable surfaces lying in the same level plane. It has now been found that such shelving can be prepared which not only expands incrementally by finite additions, but also expands levelly, with surfaces remaining planar. Accordingly, it is an object of the present invention to provide an adjustable shelving rack which expands incrementally and planarly.

It is another object of the present invention to provide for a shelving rack designed to support objects evenly, levelly, without any tilting off the plane.

It is still another object of the present invention to provide an adjustable shelving rack which can expand incrementally and stably, supporting various objects securely so there is minimal danger of these objects falling or sliding off the shelving rack.

It is still a further object of the present invention to provide an adjustable shelving rack which will support containers of small articles such as boxes of chewing gum or mints, levelly, planarly, with a minimal amount of tilting, so there is little or no chance of the various boxes or packages sliding or falling off the rack and scattering their contents.

It is even a further object of the present invention to provide an adjustable shelving rack for placing objects on display, so that labeling or information on said objects will be easier to read. The viewing of said objects will be enhanced by a minimal amount of tilting of said objects on the display rack.

DESCRIPTION OF THE PRESENT INVENTION

Figure 1:
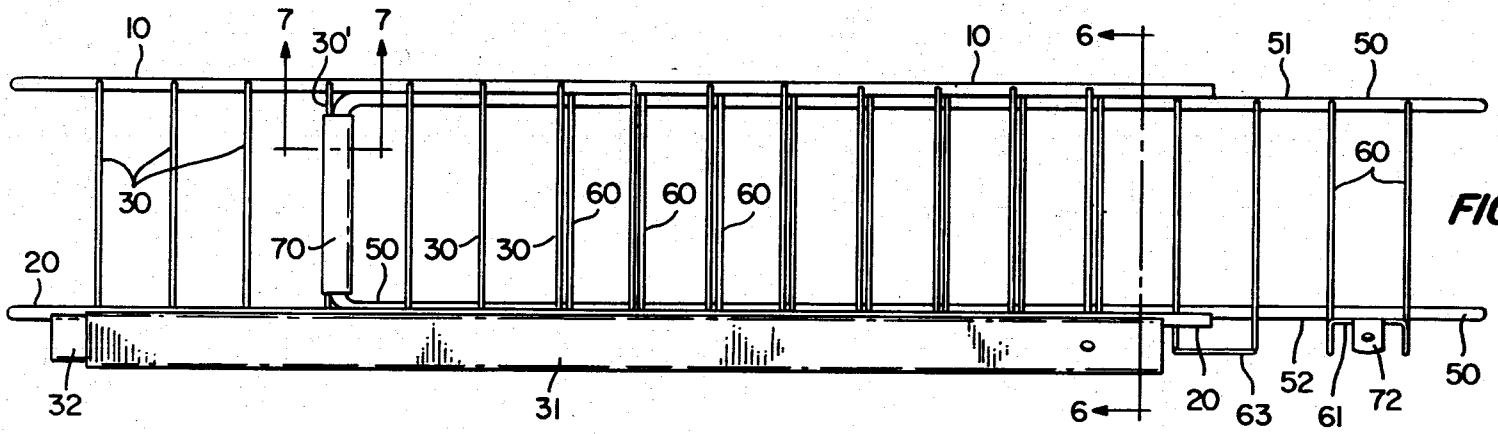
FIG. 1 is a top view of the present invention with the two elements, A and B, coupled together to form a complete shelving rack at rung 30', the fourth rung from the front of element A.
Figure 6:
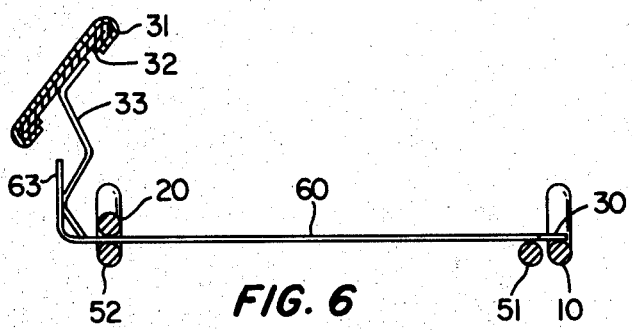

FIG. 6, as indicated in FIG. 1, is a section view of the 6—6 plane showing the two elements A and B coupled together in FIG. 1.

Figure 7:
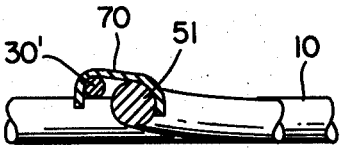

FIG. 7, as indicated in FIG. 1, is also a section view of the 7—7 plane in FIG. 1 of the two elements A and B coupled together and also discloses the coupling together of elements A and B via the pivoting lip, 70, on element B around one of the rungs, 30', on element A.

Figure 8:
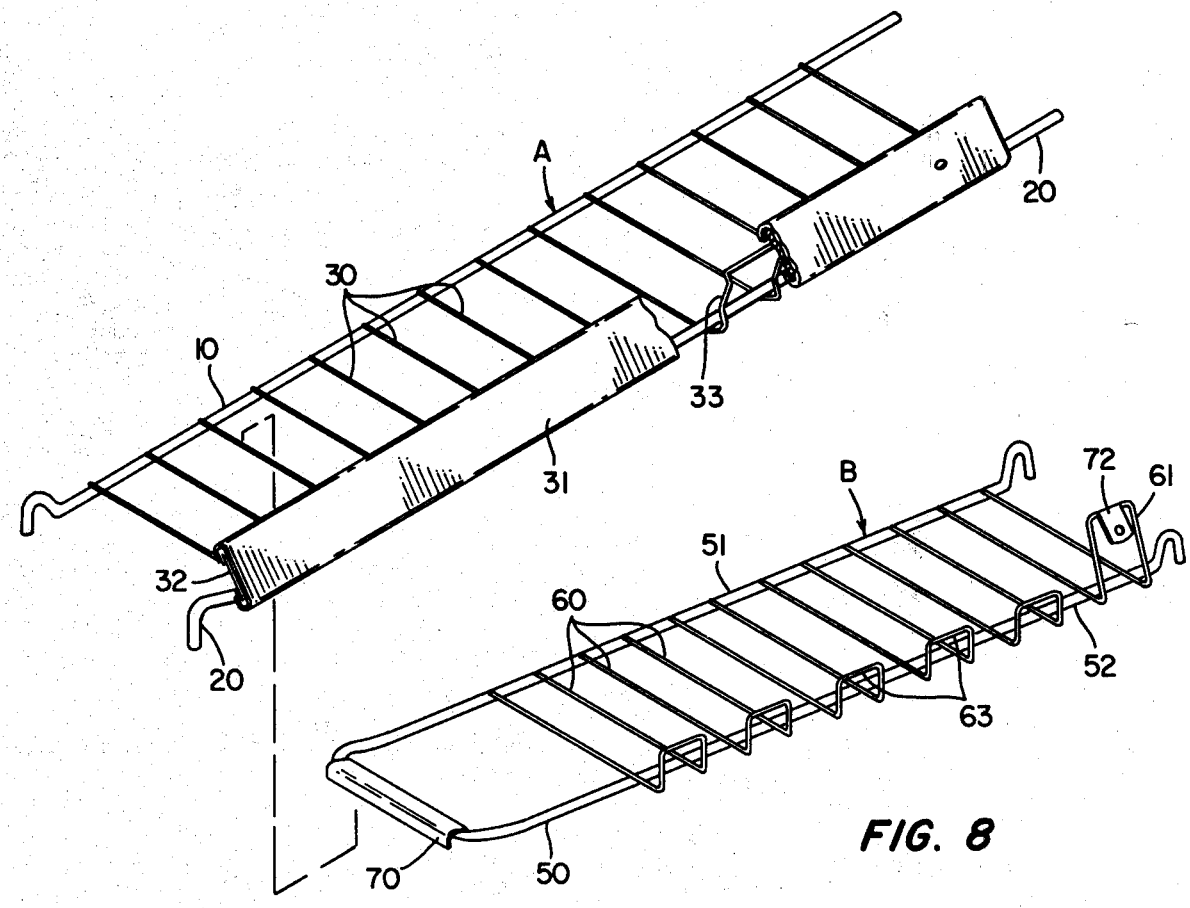

FIG. 8 discloses the two elements comprising the present shelving rack, elements A and B. The dotted line indicates the direction of coupling element B onto element A to form a complete adjustable rack. Element B may be coupled onto any of the rungs, 30, of element A to form an adjustable rack of desired width.

In this particular embodiment, as illustrated in FIGS. 1 through 6, element B is coupled onto element A at the rung 30', the fourth rung from the left end of element A. The illustrations so describe a preferred embodiment of the present invention, but are by no means intended to limit the present invention to the specific embodiment illustrated. For example, element B, may be locked onto any of the rungs, 30, of element A. The dotted line in FIG. 8 illustrates a path for hooking element B onto the third rung from the left end of element A. The fact that element B has been coupled onto rung 30', the fourth rung from the front of element A, is purely a matter of convenience for illustrative purposes.

Figure 2:
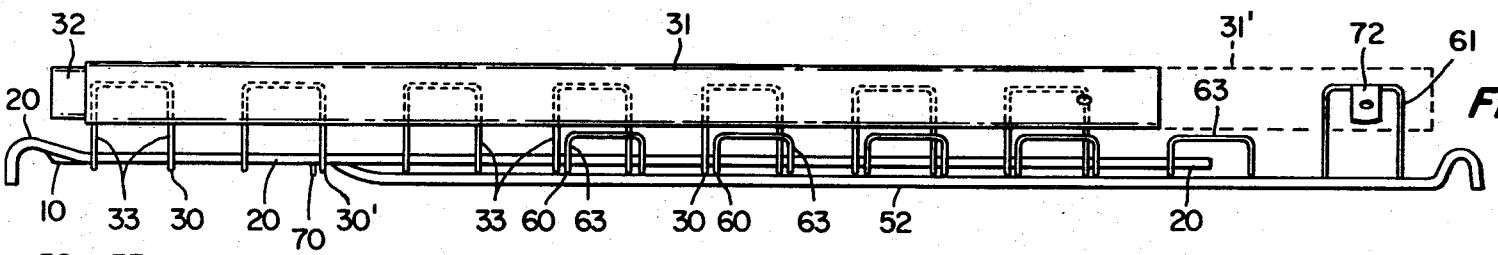
FIG. 2 is a front view of the shelving rack with the two elements A and B coupled together at rung 30' on element A to form a complete shelving rack.
Figure 3:
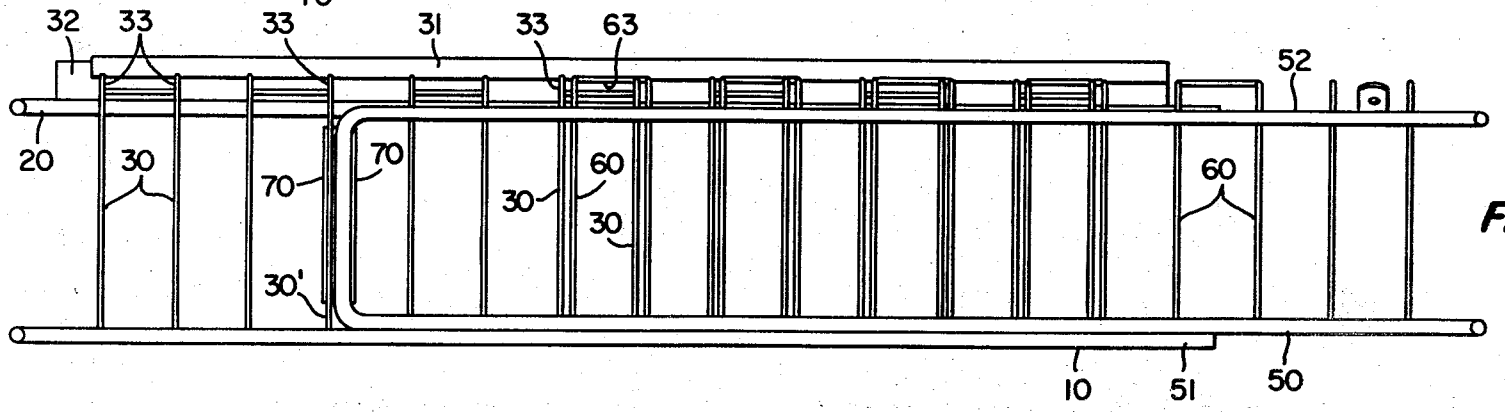
FIG. 3 is a bottom view of the two elements A and B coupled together at rung 30' on element A to form a complete shelving rack.

As depicted in the illustrations, the present invention comprises two elements which are adjustable, element A and element B. FIG. 8 describes these two elements and via the dotted line describes how these two elements may be coupled together onto any of the rungs of element A with the pivoting lip, 70, of element B. FIGS. 1, 2, and 3 are the top, front, and bottom views respectively, of these two elements when they are coupled together at rung 30' of element A, the fourth rung from the left end of element A.

Element A comprises two sections or bars, 10 and 20, which are interconnected via a plane of rungs, 30. Bars 10 and 20 are preferably parallel to one another, but need not be parallel so long as they are interconnected by a series of planar rungs. From FIG. 6, the section view of plane 6—6 in FIG. 1, it can be seen that bar 10 lies just below the plane of rungs, 30, while bar 20 lies just above the plane of rungs in element A. This attachment can also be observed in FIG. 8, where bar 10 can be seen lying below the plane of rungs, 30, and bar 20 can be seen lying above this plane of rungs in the broken view; in the top view FIG. 1, where bar 10 is seen as lying below the plane of rungs, 30, and bar 20 is seen as lying above the plane of rungs, 30; in the front view of FIG. 2, where bar 20 is seen as lying above the plane or rungs, 30; and in FIG. 3, the bottom view, where bar 20 is seen as lying above the plane of rungs, 30, and bar 10 is seen as lying below the same plane formed by the rungs, 30.

The position of these bars may be conveniently switched in alternate embodiments so that bar 10 would lie above the plane of rungs, 30, and bar 20 would lie below it. Additionally, the term "planar" is intended to mean flat, even, and level. While the planes/surfaces of the present invention may be horizontal, i.e., parallel to the ground, the present invention is by no means intended to be restricted to being parallel to the ground. The terms "above" and "below" are also intended to refer to relative positioning of members to each other and to a set, defined plane, and are not intended to refer to the ground or any outside reference standard.

These two bars, 10 and 20, may be fastened to the rungs, 30, by any conventional method of fastening or attachment such as glueing, welding, soldering, or any other conventional fastening means. All parts of the present invention may be fastened together by any conventional method of attachment such as welding, glueing, soldering, or nailing of parts together. The actual mode of fastening the particular parts or members of the present invention to each other is not critical towards the practice thereof.

Element B comprises a bar 50 which is bent around at one end underneath the fastening or pivoting lip, 70, and is interconnected by a plane of rungs, 60, as illustrated in FIG. 8. Bar 50 is bent to form two sections, 51 and 52, across which the plane of rungs, 60, lie. Sections 51 and 52 are preferably parallel to one another but need not be parallel so long as they are interconnected by a series of planar rungs. A pivoting lip, 70, is connected to the curved portion of bar 50 formed by sections 51 and 52 as illustrated. Alternatively, bar 50 need not be bent around at one end; instead, two separate bars in place of sections 51 and 52 may be attached directly to a fastening means. Each pair of horizontal rungs, 60, in element B may be bent up and around at one end to form vertical loops, 63, as illustrated in FIG. 8 and FIGS. 1, 2, and 3. The pair of rungs at the right end of this illustrated embodiment are bent to form an extended vertical loop, 61, to which is attached a fastening or reinforcing tab, 72, with a hole in the center for a fastening means.

Figure 4:
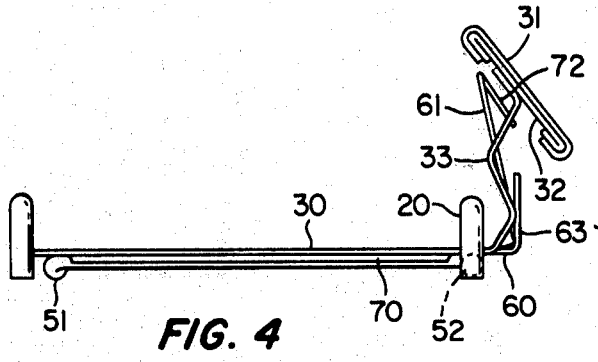
FIG. 4 is a left side view of this shelving rack with the two elements A and B coupled together at rung 30' on element A to form a complete shelving rack.
Figure 5:
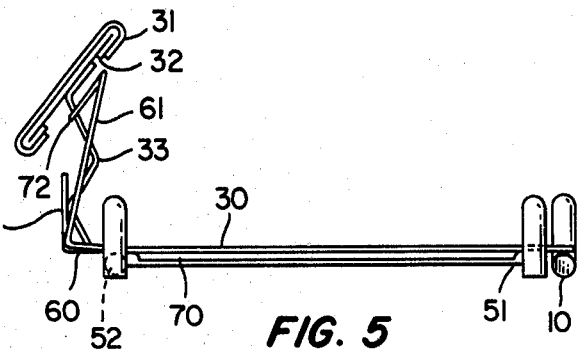
FIG. 5 is a right side view of the two elements A and B coupled together at rung 30' on element A to form a complete shelving rack.

In element A, pairs of rungs, 30, are also bent up and around at one end to form vertical loops, 33, as illustrated in left side view FIG. 4, right side view FIG. 5, front view FIG. 2, and in FIG. 3, the bottom view. The loops, 33, on element A are connected to a reinforcing lip which comprises a stationery piece, 32, circumscribed by a movable sliding lip, 31, which contains a fastening hole at one end. These vertical loops, 33, on element A may be bent in zig-zag formation as illustrated in FIGS. 4 and 5 to avoid interference with vertical loops 63 of element B when the two elements are fastened together. Although alternate pairs of rungs are extended to form vertical loops on both elements in the presently illustrated embodiment, particular formation of these loops at right angles to the horizontal plane is not necessary to the practice of the present invention. Additionally, although the present embodiment illustrates these loops on one side, the right side of the rack, these loops may be conveniently formed on the opposite or left side of the rack.

As can be observed in FIG. 2, this sliding lip, 31, may be slid out along the dotted lines to slide immediately over the extended hook, 61, of element B and the fastening or reinforcing tab, 72, attached to extended hook, 61. In the illustrated embodiment, this sliding lip may then be fastened to the reinforcing tab, 72, with any conventional fastening means, i.e., a screw, a bolt, placed through the two fastening holes which will then completely lock the two elements A and B into place forming a stable, level, planar shelving rack. It should be pointed out that the illustrated embodiment is only a suggested means of reinforcing elements A and B together. Elements A and B may be reinforced by any other conventional means such as by, glueing, welding, soldering or locking the particular elements into place, or by wiring loops, 63, of element B and loops, 33, of element A together. The mechanism of reinforcement via a sliding lip 31, bolted to tab 72 as described in the present illustrations is only intended as a description of a preferred embodiment and is not intended as the sole method of bracing, fastening, or reinforcing the two elements A and B together. Alternatively, the two elements A and B need not be additionally reinforced together other than the hooking or snapping of lip 70 onto any of the rungs, 30, of element A, if the shelving rack is placed on a secure, supportable outside frame structure capable of holding the rack stably without additional reinforcement.

Bars or sections 10 and 20 of element A may be conveniently formed into hooks at one end, while bar 50 of element B, may be conveniently formed into hooks at the end opposite the pivoting lip 70. These hooks are shaped so that the two elements A and B, when coupled into place, may be fitted over a stationary frame structure of desired width, which will lend support to the shelving rack, coupled into place and forming one planar surface. Several such shelving racks may be placed onto such a stationary frame structure at different heights forming a series of planar shelving racks adjusted to a desired width.

As was noted supra, bars 10 and 20 are respectively interconnected below and above the plane formed by the rungs, 30, of element A, best illustrated in the section view of FIG. 6. The bar 50 of element B, which is curved at one end and attached to reinforcing lip 70 has sections 51 and 52 which are separated, preferably at right angles, by a plane of rungs, 60. The width between members 51 and 52 of bar 50 may be of any determinate width, but is preferably smaller than the distance between bars 10 and 20 of element A (the distance between bars 10 and 20 of element A may be of any determinate width too). In the illustration at hand, the distance between sections 51 and 52 of element B in the plane formed by rungs 60 is slightly smaller than the distance between bars 10 and 20 of element A. This is again best illustrated in FIG. 6.

In the presently disclosed embodiment, section 52 of bar 50 sits directly below bar 20 while section 51 of bar 50 sits just inside bar 10 of element A when the two elements A and B are coupled into place. This enables the two elements A and B to be snapped securely and planarly into level positions. More importantly, this feature enables the rungs 30 of element A and the rungs 60 of element B to lie in the same level plane, with no uneven elevation or depression between any of the rungs of these two elements. This can best be observed in FIG. 6 where the rungs of element A, 30, and the rungs of element B, 60, all lie in a completely flat plane with no rungs of either element lying above or below the rungs of the other element. Rungs 30 and 60 all lie in the same plane which is preferably horizontal but need not be horizontal so long as all rungs lie in the same plane.

It should be pointed out that while section 52 of bar 50 is illustrated as directly below bar 20 of element A, it is not necessary that this section sit directly below bar 20, of the first member A, so long as all rungs of both elements lie in the same plane when the two elements are coupled together. As was pointed out supra, the distance between sections 51 and 52 of the bar 50 of the second member may be of any convenient width just as the distance between the parallel bars of the second element may be of any convenient width, so long as all the rungs of both elements lie in the same plane on coupling. The critical feature is that the bars 10 and 20 of element A be formed on opposite sides of the plane of rungs so that when the two elements are coupled together, one of the sections of element B will be on the same side of the plane of rungs as one of the sections or bars of element A while the other section of element B will be on the opposite side of the plane of rungs from the other bar in element A. This allows the rungs of elements A and B to all lie in the same plane.

FIG. 7, a section view along plane 7—7 from FIG. 1, illustrates the particular snapping or hooking mechanism of pivoting lip, 70, onto horizontal rung 30', the fourth rung from the front in element A. Pivoting lip 70 has been attached onto the bar 50 of element B which is curved around at a right angles to sections 51 and 52 at this point. Pivoting lip, 70, may be of any determinate length along bar 50, but it should be less than the width between bars 10 and 20 on element A, so that the pivoting lip may snap comfortably and securely over any horizontal rung, 30, of element A, in accordance with the dotted line in FIG. 8, illustrating the direction for locking elements A and B together via the hooking or snapping of pivoting lip 70 around any rung, 30, of element A. Pivoting lip 70 should be so shaped and bent that it snaps comfortably and securely over any rung, 30, of element A in accordance with the sectional view in FIG. 7. Pivoting lip 70 may be snapped over any rung depending on the desired width of the shelving rack to be secured to an outer structural frame or support.

The left and right side views in FIGS. 4 and 5 also illustrate the planar leveling of the two elements where neither the rungs, 30, of element A, nor the rungs, 60, of element B, lie above or below the plane. This is illustrated where the extended loops 33 of rungs 30 and 63 of rungs 60, all curve into the same plane just above bar 50. This is also illustrated in FIG. 3, the bottom view, where the series of rungs 30 and 60 of elements A and B respectively lie above the plane formed by sections 51 and 52 of bar 50 of element B, and below bar 20 of element A; and in the top view of FIG. 1, where the rungs, 30, of element A are seen as lying above bar 10 but below bar 20, while the rungs, 60, of element B lie below bar 20, and section 52 of bar 50 lies directly adjacent to bar 10.

It should be pointed out that the invention illustrated herein need not be viewed from only one angle, Typically, one might turn these two coupled elements upside down. All rungs of both elements will still be lying in the same plane in this upside down view. The parts of the present invention are positioned in relation to each other, not with respect to the ground or any outside reference standard.

Any object placed on the plane of rungs of this shelving rack, will rest levelly, and securely, with minimal chance of tilting and minimal danger of tipping or falling off the rack. Adjustable shelving rack of this kind is ideal for supporting boxes of chewing gum or mints on display. Chewing gum boxes are supported stably and levelly, with little danger of falling off the display rack. Also, boxes of chewing gum or mints and like objects on display will have their aesthetic appeal enhanced by not being viewed at a skewed angle, and by being easier to read when resting on a level plane.

PREFERRED DIMENSIONS

The various members, rungs, bars and element of the present invention may be of any particular size or dimension, but certain dimensions are preferred. The following illustrated embodiment is intended as a mere representative example of the present invention and is not intended to limit the scope of the present invention.

Generally, in element A, bars 10 and 20 are each from about 50 cm. to about 125 cm. long and are from about 10 cm. to about 50 cm. apart. The rungs, 30, of element A connecting bars 10 and 20 are from about 2 cm. to about 4 cm. apart, and the loops 33 formed by said rungs are from about 4 cm. to about 8 cm. high, off the plane. There are generally from about 5 to about 15 rungs on element A.

Regarding element B, sections 51 and 52 of bar 50 are from about 50 cm. to about 125 cm. long and from about 10 cm. to about 50 cm. apart. Rungs, 60, interconnecting these two sections are spaced about 2 cm. to about 4 cm. apart, and form loops, 63, from about 2 cm. to about 8 cm. high off the plane. There are generally from about 5 to about 15 rungs on element B.

In the illustrated embodiment bars 10 and 20 of element A are about 55.8 cm. long and about 12.7 cm. apart. They are interconnected by rungs, 30, spaced about 2.54 cm. apart, about fourteen rungs in all. These rungs, 30, alternately form loops 33 about 5 cm. high which are connected to the sliding lip 31 at the stationary portion 32. Sections 51 and 52 of bar 50 in element B are approximately 55.8 cm. long and about 12.7 cm. apart. Rungs 60 interconnecting these two sections are about 2.54 cm. apart, about twelve rungs in all. This element may comprise more rungs, if necessary, towards section 51 of bar 50 and the pivoting lip 70. These rungs, 60, are formed into loops 63, in pairs, which are about 2.5 cm. high. The pair of rungs furthest from section 51 and pivoting lip 70 forms a larger loop, 61, about 7.6 cm. high to which the reinforcing tab 72 is attached. This is the reinforcing tab which is connected to the sliding lip 70 through the illustrated holes by a fastening means such as a nut and bolt or screw.

In a larger preferred embodiment, bars 10 and 20 of element A are about 81.28 cm. long and about 12.7 cm. apart, interconnected by rungs, 30, spaced about 3.81 cm. apart, about 14 rungs in all. These pairs of rungs, 30, form loops, 33, about 5.08 cm. high, connected to the sliding lip 31 at the stationary portion 32. Sections 51 and 52 of bar 50 in element B are about 55.88 cm. long and about 12.7 cm. apart. Rungs, 60, which interconnect these two sections are about 2.54 cm. apart, about twelve rungs in all, with pairs of these rungs forming loops, 63, about 2.5 cm. high. The pair of rungs, 60, furthest from section 51 and pivoting lip 70 forms a larger loop, 61, about 7.6 cm. high to which the reinforcing tab 72 is attached.

I claim:

1. An adjustable shelving rack comprising two elements wherein

A. the first element comprises two sections interconnected by a series of planar rungs, one section above the plane formed by said rungs and the other section below the plane formed by said rungs;

B. the second element comprises two sections supporting a series of planar rungs with both sections on the same side of the plane formed by said rungs;

such that when both elements are coupled together the rungs of both elements all lie in the same plane.

2. The adjustable shelving rack of claim 1 where the first and second elements are coupled together.

3. The adjustable shelving rack of claim 2 where the second element hooks around a rung of the first element.

4. The adjustable shelving rack of claim 3 wherein the two sections of the first element interconnect the series of planar rungs at right angles, and the two sections of the second element interconnect the series of planar rungs at right angles.

5. The adjustable shelving rack of claim 4 where one section of the second element is directly below one section of the first element and the other section of the second element is adjacent to the other section of the first element.

6. The adjustable shelving rack of claim 5 where the rungs of the first and second elements all form a horizontal plane.

7. The adjustable shelving rack of claim 5 where the first and second elements are additionally reinforced to one another.

8. The adjustable shelving rack of claim 7 where the first and second elements are reinforced by a sliding lip attached to extensions of the rungs of the first element which slides out and is fastened to a fastening means connected to an extension of at least one rung of the second element.

* * * * *